US011750988B2

(12) United States Patent
Flaherty et al.

(10) Patent No.: US 11,750,988 B2
(45) Date of Patent: Sep. 5, 2023

(54) TYMPANIC LENS FOR HEARING DEVICE WITH REDUCED FLUID INGRESS

(71) Applicant: Earlens Corporation, Menlo Park, CA (US)

(72) Inventors: Bryan Flaherty, Mountain View, CA (US); Daniel Hallock, Redwood City, CA (US); James Silver, Palo Alto, CA (US); Kyle Imatani, Mountain View, CA (US); Eduardo Sager, Milpitas, CA (US); Ketan Muni, San Jose, CA (US); Ohnmar Khin, Newark, CA (US)

(73) Assignee: Earlens Corporation, Menlo Park, CA (US)

( * ) Notice: Subject to any disclaimer, the term of this patent is extended or adjusted under 35 U.S.C. 154(b) by 180 days.

(21) Appl. No.: 17/412,850

(22) Filed: Aug. 26, 2021

(65) Prior Publication Data

US 2021/0392449 A1 Dec. 16, 2021

Related U.S. Application Data

(63) Continuation of application No. PCT/US2019/019877, filed on Feb. 27, 2019.

(51) Int. Cl.
*H04R 17/00* (2006.01)
*H04R 25/00* (2006.01)

(52) U.S. Cl.
CPC ..... *H04R 25/658* (2013.01); *H04R 2225/77* (2013.01)

(58) Field of Classification Search
CPC ..... H04R 17/00; H04R 25/606; H04R 25/65; H04R 2225/67
USPC ..... 381/111, 190–191
See application file for complete search history.

(56) References Cited

U.S. PATENT DOCUMENTS

2017/0180888 A1* 6/2017 Andersson ..... H04R 25/606

* cited by examiner

*Primary Examiner* — George C Monikang
(74) *Attorney, Agent, or Firm* — Polsinelli PC

(57) ABSTRACT

Embodiments of the invention are directed to a microactuator including using (i) an ingress membrane mounting ring adhesive positioned on an ingress membrane mounting surface to mount an ingress membrane and (ii) a flexible encapsulation shield mounted on a support band and extending over the ingress membrane mounting ring and (iii) a first reed adhesive connecting the ingress membrane to a microactuator reed at an ingress membrane reed opening and (iv) a second reed adhesive positioned on and covering the first reed adhesive, the second reed adhesive extending from the ingress membrane to the microactuator reed.

23 Claims, 6 Drawing Sheets

TYMPANIC LENS FOR HEARING DEVICE WITH REDUCED FLUID INGRESS

CROSS-REFERENCE

This application is a continuation of PCT Application No. PCT/US19/19877, filed Feb. 27, 2019; which is incorporated herein by reference in its entirety.

BACKGROUND OF THE INVENTION

In hearing devices, including contact hearing devices which utilize microactuators, including balanced armature microactuators, such as the contact hearing aids available from Earlens Corporation, the microactuator may include one or more ingress membranes intended to prevent fluid from getting into the microactuator (i.e., to prevent fluid ingress). Such ingress membranes may be subject to failure modes, including delamination or tearing, which may result in fluid ingress. In certain circumstances, fluid in the microactuator may cause the microactuator to fail or the output of the microactuator to decrease. Delamination of the ingress membrane is most likely to occur at bonding joints and may be caused by swelling of the ingress membrane material (which may be, for example, ESTANE 58300) or by swelling of the adhesive (which may be, for example, UV15X-6MED-2) used to affix the ingress membrane material to the microactuator in the presence of fluids. In contact hearing devices which are placed in the ear canal of a user, the ingress membrane may be exposed to any one of a number of bodily fluids (including cerumen and sweat) and/or fluids introduced into the ear canal by the user or health care professional (including water, alcohol, and mineral oil). In such microactuators, the bonding joints may include joints at the interface between the ingress membrane and the body of the microactuator and at the interface between the ingress membrane and the output reed. Potential benefits to improved adhesion at the microactuator-ingress membrane interface and the ingress membrane-reed interface may include more a stable output, a more stable Maximum Effective Power Output (MEPO), reduced sound variability, reduced need for manufacturing remakes and reduced returns for credit.

In some hearing devices, delamination of the ingress membrane at an adhesive joint is a mechanism of failure which may result in fluid getting into the interior of the microactuator. In certain circumstances, the ingress membrane material may swell, causing the adhesive joints to break. In certain circumstances, a 20% or greater change in the volume of the ingress membrane material may break bonds between the adhesive and the ingress membrane. When fluid gets past the ingress membrane, it can cause the performance of the contact hearing aid to degrade. For example, the degradation in performance may include intermittent output, reduced output and/or reduced MEPO. Alternatively, the contact hearing aid may fail entirely and provide no output. In some microactuators, there are two key areas at which an ingress membrane bond can fail, including around the attachment point to the microactuator, which may be a stainless steel ring, and at the attachment point to the microactuator reed. Observations have shown that approximately 58% of failures occur at the ring, 6% at reed, and 21% occur at both the ring and the reed. The ingress membrane itself can also fail in approximately 15% of cases. In earlier designs, this issue was addressed by bonding a thin polyurethane ingress membrane (Estane 58300 available from Lubrizol) with an epoxy-based adhesive (UV-15X, available from Masterbond). However, testing in real world and simulated ear environment (containing artificial sweat, artificial cerumen, and mineral oil) has shown that this bond has poor durability.

In order to improve the performance of contact hearing aids including microactuators which utilize ingress membranes to prevent fluids from entering the microactuator, the adhesion of the microactuator ingress membrane to the microactuator and the microactuator reed may be improved by using the apparatuses and methods described herein. In addition, it may be possible to improve the ingress characteristics of the completed microactuator by employing a suitable pre-treatment of the ingress membrane material and/or materials coating the surface of the microactuator. In prior devices, the ingress membrane may be formed of polyurethane or polyetherurethane, for example, Estane 58300. In prior devices, the ingress membrane may be attached to the microactuator at a stainless steel support member using an epoxy adhesive such as UV15X-6MED-2. In prior devices, OG-116 was used as both the binding adhesive between the ingress membrane and the ingress membrane mounting adhesive.

BRIEF DESCRIPTION OF THE DRAWINGS

The foregoing and other objects, features and advantages of embodiments of the present inventive concepts will be apparent from the more particular description of preferred embodiments, as illustrated in the accompanying drawings in which like reference characters refer to the same or like elements. The drawings are not necessarily to scale, emphasis instead being placed upon illustrating the principles of the preferred embodiments.

DETAILED DESCRIPTION OF THE INVENTION

The present invention is directed to an ingress membrane for use in sealing the open end of a balanced armature microactuator used in a lens mounted on the eardrum of a user. The ideal ingress membrane would not swell, would bond easily to the microactuator, and would not become delaminated following exposure to oil, water, cerumen, or other fluids commonly found in the ear. In embodiments of the invention, the ideal ingress membrane would not interfere with the frequency response of the balanced armature microactuator. In embodiments of the invention, the ingress membrane may be attached to the microactuator by at least two connection points, in one example, the first connection point may be a stainless steel support member at an open end of the microactuator and the second connection point may be a point on the microactuator reed.

Figure 1:
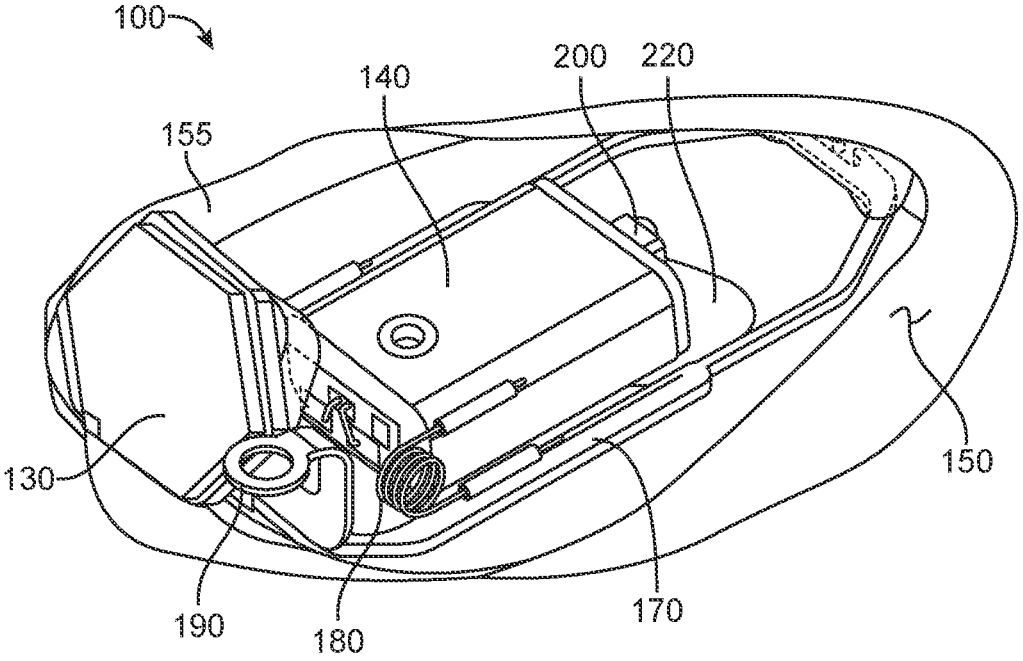
FIG. 1 is a top perspective view of a contact hearing device according to the present invention.
Figure 2:
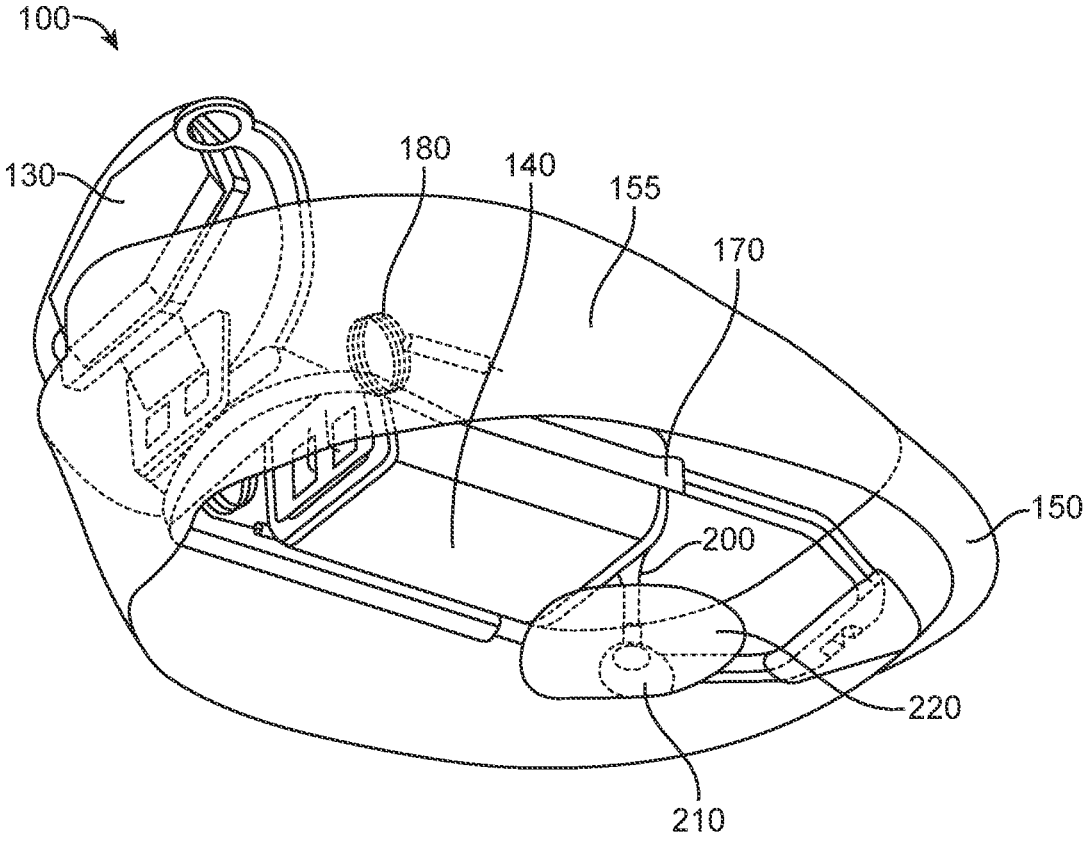
FIG. 2 is a bottom perspective view of a contact hearing device according to the present invention.

FIG. 1 is a top perspective view of a contact hearing device 100, which may also be referred to as a tympanic lens, according to the present invention. FIG. 2 is a bottom perspective view of a contact hearing device 100 according to the present invention. In the contact hearing device of FIGS. 1 and 2, a perimeter platform 155 is mounted on a chassis 170. Perimeter platform 155 may include a sulcus platform 150 at one end of perimeter platform 155. Chassis 170 may further include bias springs 180 (which may also be referred to as torsion springs) mounted thereon and supporting microactuator 140. Microactuator 140 is connected to drive post 200, which is connected to umbo lens 220 by adhesive 210. Chassis 170 further supports grasping tab 190 and photodetector 130. In embodiments of the invention, signals may be transmitted to contact hearing device 100 by, for example, light, magnetic coupling or radio frequency transmission. In embodiments of the invention, element 130 may be a receiving coil or an antenna.

Figure 3:
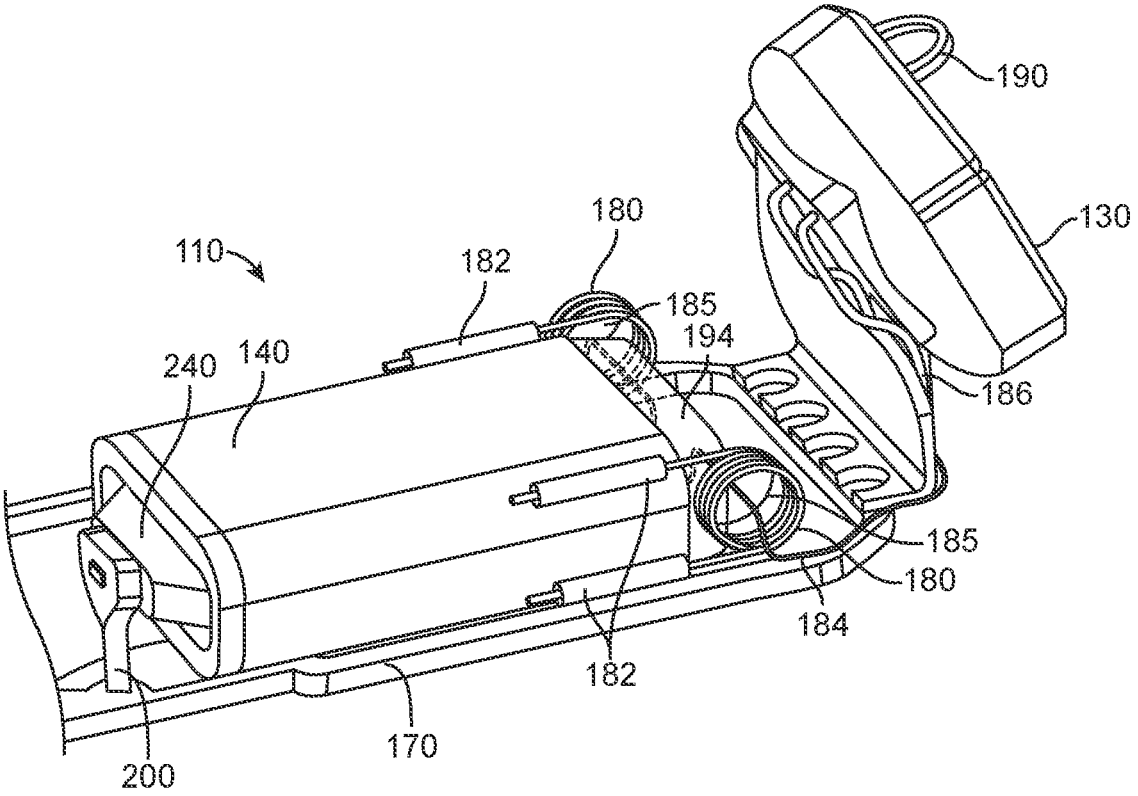
FIG. 3 is a top perspective view of a motor assembly for a contact hearing device according to the present invention.

FIG. 3 is a top perspective view of a motor assembly 110 for a contact hearing device according to the present invention. Motor assembly 110 includes bias springs 180 which are connected to microactuator 140 and chassis 170 by hypo-tubes 182. In embodiments of the invention, bias springs 180 include damper 185. Motor assembly 110 may further include photodetector 130, which is electrically connected to microactuator 140 by photodetector wires 186 and microactuator wires 184. Microactuator 140 may be protected by a potting material 194. Motor assembly 110 may further include grasping tab 190, drive post 200, and ingress membrane 240.

Figure 4:
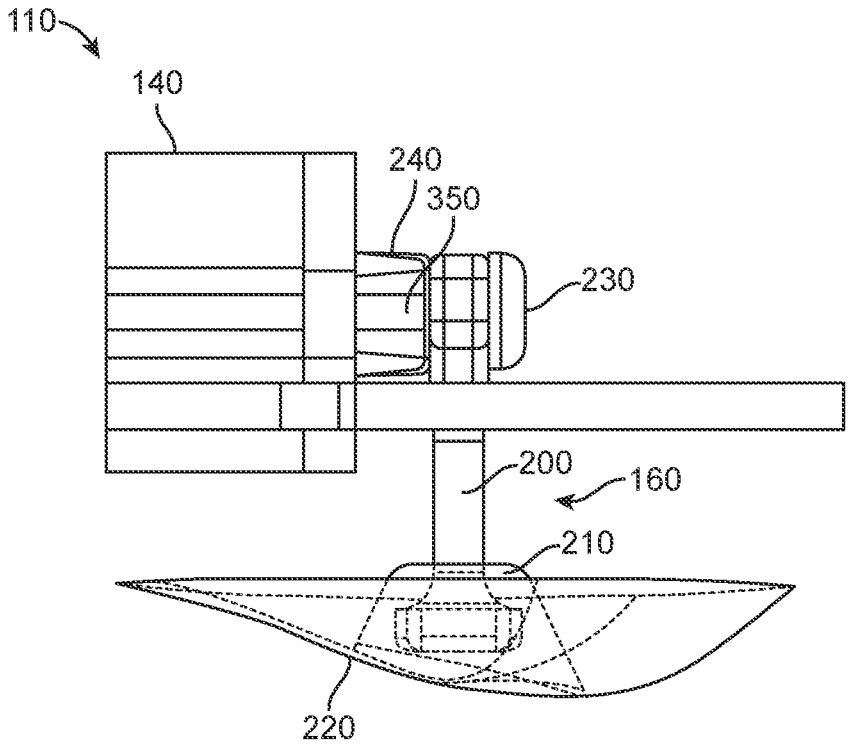
FIG. 4 is a side view of the distal end of a motor assembly for a contact hearing device according to the present invention

FIG. 4 is a side view of the distal end of a motor assembly 110 for a contact hearing device according to the present invention. FIG. 4 is a side view of a distal end of motor assembly 110 including microactuator 140 and umbo platform 160 according to the present invention. Microactuator 140 includes ingress membrane 240 and reed tip 230, which is positioned at the distal end of microactuator reed 350. Umbo platform 160, which is attached to microactuator 140, includes drive post 200, adhesive 210 and umbo lens 220. Umbo platform 160 is attached to microactuator reed 350 at a proximal end of drive post 200.

Figure 5:
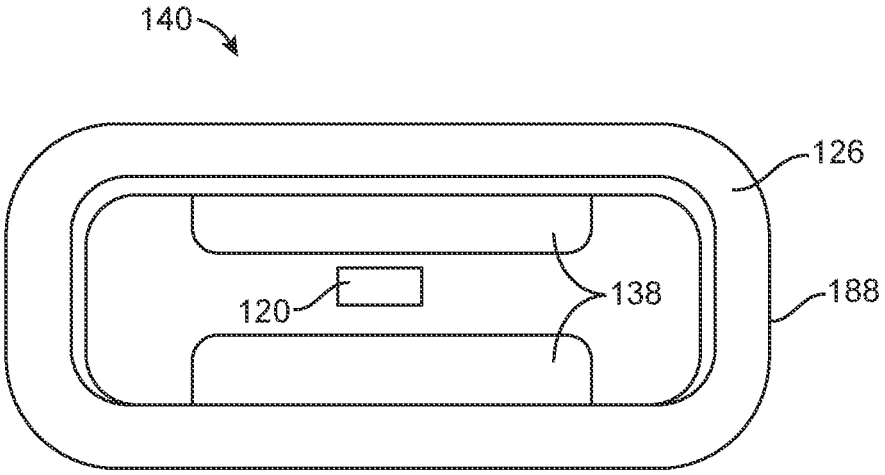
FIG. 5 is an end view of a partially assembled microactuator for a contact hearing device according to the present invention.

FIG. 5 is an end view of a partially assembled microactuator 140 for a contact hearing device according to the present invention. In FIG. 5, microactuator 140 includes end ring 188, magnets 138, and microactuator reed 120. End ring 188 includes ingress membrane mounting surface 126. The partially assembled microactuator 140 illustrated in FIG. 5 does not include ingress membrane 240.

Figure 6:
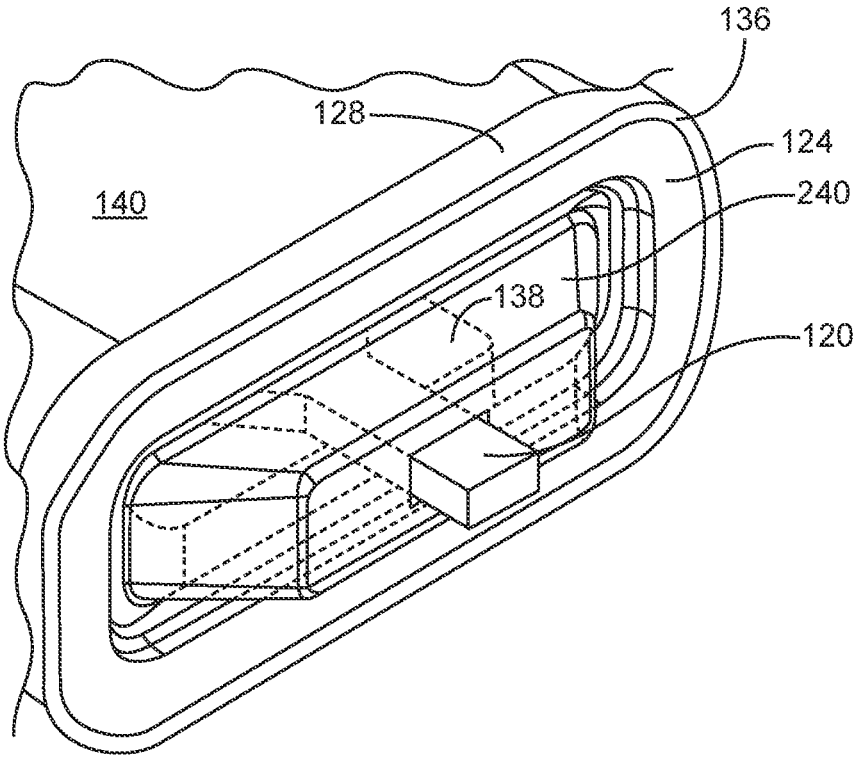
FIG. 6 is a perspective view of the distal end of a partially assembled microactuator for a contact hearing device according to the present invention.

FIG. 6 is a perspective view of the distal end of a partially assembled microactuator 140 for a contact hearing device according to the present invention. In FIG. 6, microactuator 140 includes encapsulation shield 128, ingress membrane 240, microactuator reed 120, and magnets 138. Ingress membrane 240 includes ingress membrane mounting ring 124. Encapsulation shield 128 includes encapsulation lip which, in some embodiments, extends over a portion of ingress membrane mounting ring 124. Encapsulation shield 128 includes encapsulation lip which, in some embodiments, extends over all of ingress membrane mounting ring 124.

Figure 7:
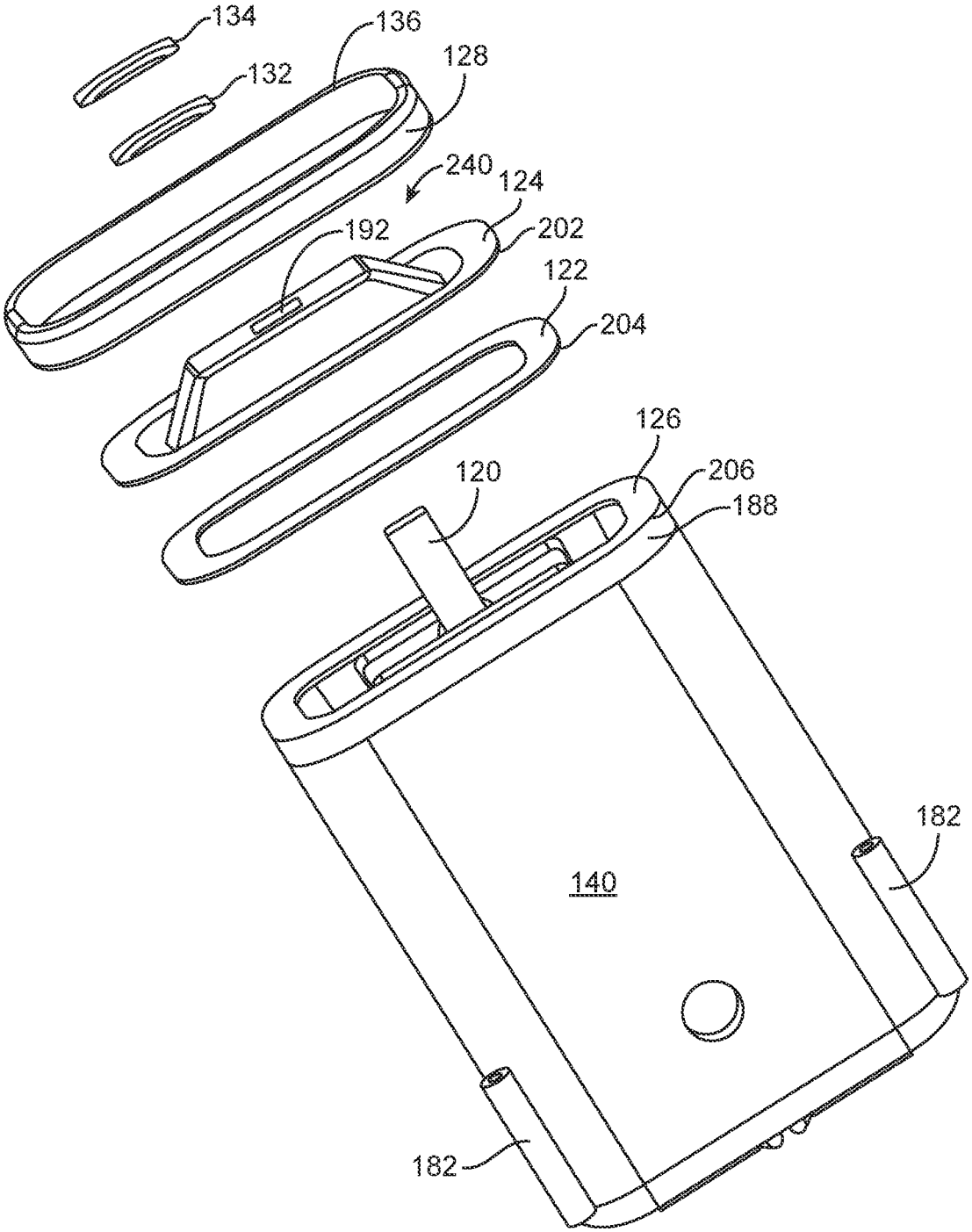
FIG. 7 is an exploded perspective view of a microactuator for a contact hearing device according to the present invention.

FIG. 7 is an exploded perspective view of a microactuator for a contact hearing device according to the present invention. In the embodiment of FIG. 7, microactuator 140 includes hypo-tubes 182, end ring 188, microactuator reed 120, and ingress membrane 240. End ring 188 includes ingress membrane mounting surface 126. Ingress membrane 240 includes ingress membrane mounting ring 124 and reed slot 192. Ingress membrane 240 is affixed to end ring 188 by ingress membrane mounting ring adhesive 122, which is positioned on ingress membrane mounting surface 126 of end ring 188 and on the proximal side of ingress membrane mounting ring 124. Encapsulation shield 128 encapsulates the outer edge 202 of ingress membrane mounting ring 124, the outer edge 204 of ingress membrane mounting ring adhesive 122, and the outer edge 206 of ingress membrane mounting surface 126. In embodiments of the invention, encapsulation lip 136 extends over at least a portion of ingress membrane mounting ring 124. Reed 120 extends through reed slot 192 in ingress membrane 240 and is affixed to reed slot 192 by at least a first reed adhesive 132, which acts as a binding adhesive. In embodiments of the invention, a second reed adhesive 134 may also be used at the ingress membrane 240 to microactuator reed 120 interface. In embodiments of the invention, the second reed adhesive 134 may act as a protective adhesive or an encapsulation shield.

Figure 8:
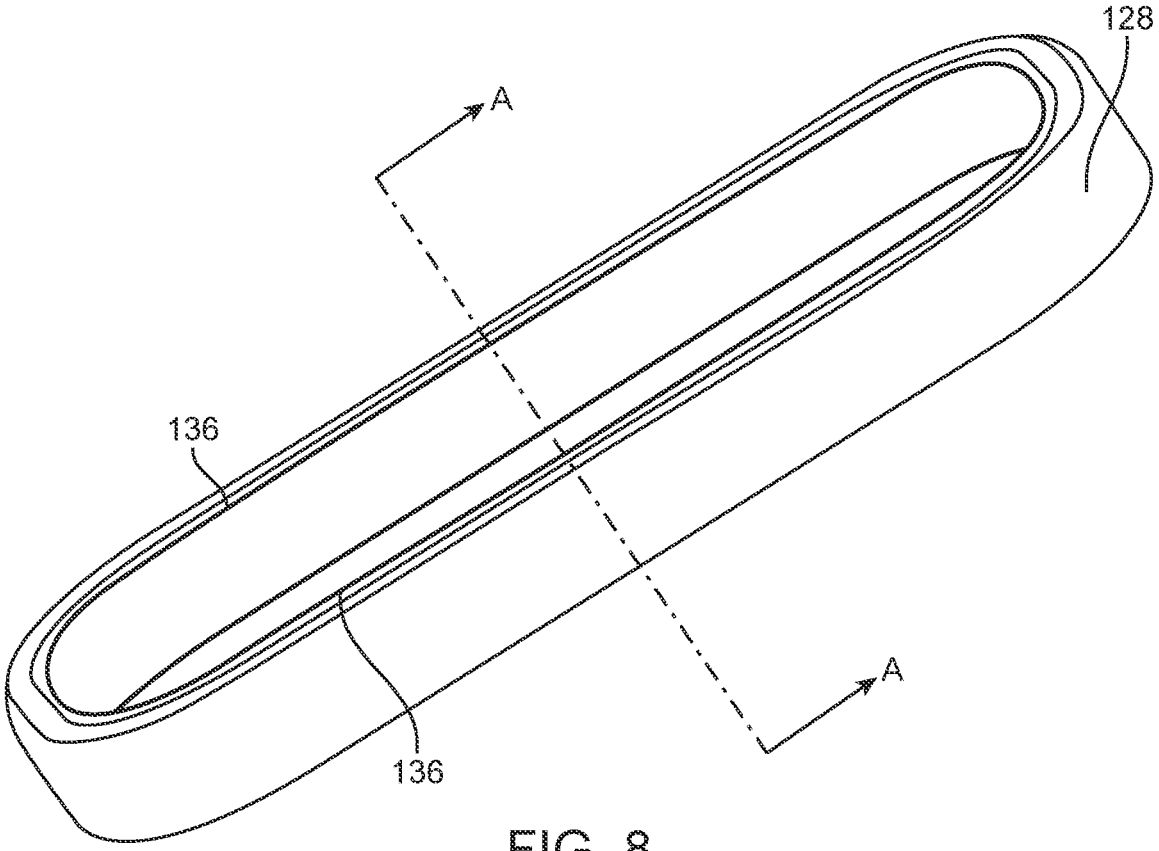
FIG. 8 is a perspective view of an adhesive ring according to the present invention.
Figure 9:
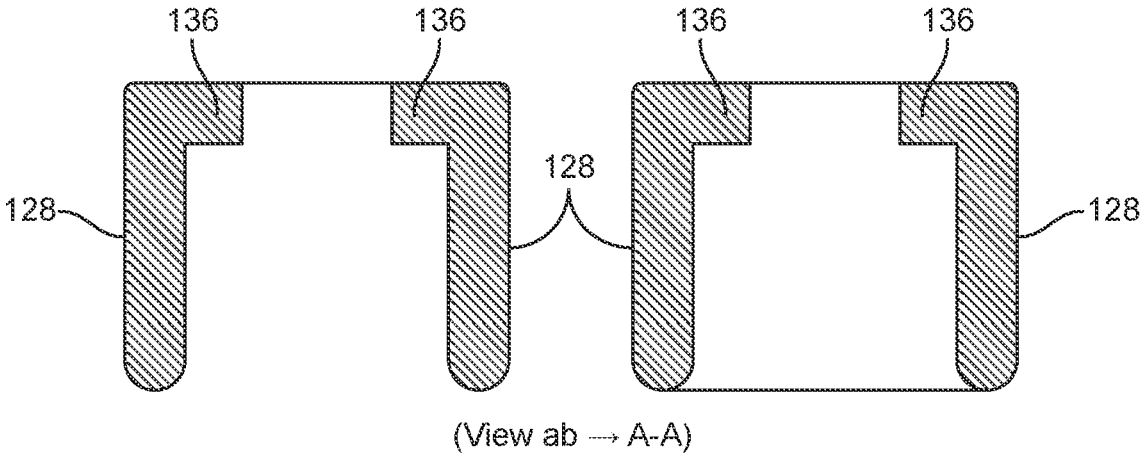
FIG. 9 is a cutaway end view of the adhesive ring of FIG. 8 viewed along cutaway A-A.

FIG. 8 is a perspective view of encapsulation shield 128 according to the present invention. FIG. 9 is a cutaway end view of adhesive shield 128 of FIG. 11 viewed along cutaway A-A. Encapsulation shield 128 may include encapsulation lip 136.

The present invention is directed to an ingress membrane for use in sealing the open end of a balanced armature microactuator used in a hearing aid lens mounted on the eardrum of a user. In embodiments of the invention, the ingress membrane may include an ingress membrane mounting ring including an outer edge. In embodiments of the invention, the interface between the outer edge of the membrane mounting ring and the outer edge of the mounting surface may be covered by an encapsulation shield, which may extend onto the ingress membrane mounting ring and the end ring. In embodiments of the invention, the encapsulation shield may be made from a flexible cyanoacrylate such as, for example, Loctite 4861. In embodiments of the invention, the ingress membrane may further be attached to the microactuator reed using a binding adhesive layer and, in some embodiments, an encapsulation shield. In embodiments of the invention, the binding adhesive layer may be, for example, UV15X-6MED-2 and the encapsulation shield may be, for example, Loctite 4861.

In embodiments of the invention, the encapsulation shield is positioned to encapsulate the junction between the outer edge of the ingress membrane, the outer edge of the ingress membrane mounting ring adhesive and the outer edge of the ingress membrane mounting surface. The encapsulation shield is positioned to shield that junction and prevent fluids from reaching that junction, thus preventing fluid ingress into the microactuator.

In embodiments of the invention, the second reed adhesive is positioned to cover at least a portion of the first reed adhesive, including the junction between the first reed adhesive and the microactuator reed. In embodiments of the invention, the second reed adhesive is positioned to cover at least a portion of the first reed adhesive, including the junction between the first reed adhesive and the ingress membrane. In embodiments of the invention, the second reed adhesive is positioned to cover both the junction between the first reed adhesive and the microactuator reed and the junction between the first reed adhesive and the ingress membrane. In embodiments of the invention, the second reed adhesive is positioned to prevent fluid ingress through the junction between the first reed adhesive and the microactuator reed. In embodiments of the invention, the second reed adhesive is positioned to prevent fluid ingress between the first reed adhesive and the ingress membrane. In embodiments of the invention, the second reed adhesive is positioned to prevent fluid ingress between both first reed adhesive junctions.

In embodiments of the invention, the stainless steel ring provides a platform for attaching the ingress membrane. In embodiments of the invention, the ingress membrane acts as a barrier to prevent liquid and/or particle ingress. In embodiments of the invention, the reed may be a very thin material which bends easily. In embodiments of the invention, the ingress membrane may be designed as a bellows to minimize its stiffness and the impact connecting it to the reed has on reed motion.

In embodiments of the invention, in order to facilitate attachment, the microactuator (which may be coated in a protective coating of, for example, parylene) and the ingress membrane may be subjected to a plasma treatment prior to attaching the ingress membrane to the microactuator. The purpose of the plasma treatment is to wet the surfaces (to allow the adhesive to flow more freely) and to create chemical functional groups on the surface of the parylene and ingress membrane (to strengthen the bond between the adhesive and the parylene/ingress membrane).

In embodiments of the invention, key characteristics of materials suitable for use as an ingress membrane include: a low modulus (low enough to not add stiffness to the reed/low enough to allow the reed to move freely); a thin cross section (for example, a cross section between 10 and 11 microns thick); resistance to swelling in in fluids, including bodily fluids (e.g., sweat) and fluids inserted into the ear canal by a user (e.g., oil); and biocompatibility with the environment of the ear canal. In embodiments of the invention, the ingress membrane may be an elastomeric material, a polyurethane material, a polyetherurethane material (such as Estane 58300), a fluoropolymer (such as THV—a terpolymer of tetrafluoroethylene, hexafluoropropylene and vinylidene fluoride), a co-polyester-ether (such as Ecdel), a polycarbonateurethan silicon blend (such as ChronoSil).

In embodiments of the invention, second reed adhesive 134 may be a flexible cyanoacrylate adhesive. In embodiments of the invention, second reed adhesive 134 may be Loctite 4861. In embodiments of the invention, second reed adhesive 134 may be a flexible epoxy or flexible silicone adhesive. In embodiments of the invention, second reed adhesive 134 may have one or more of the following characteristics: a relatively low durometer, e.g. 95A on the Shore scale or less; a durometer which is higher than the durometer of the ingress membrane material; a durometer which is within ten percent of the durometer of the ingress membrane material; or a viscosity of between approximately 3000 and 5500 centipoise.

In embodiments of the invention, first reed adhesive 132 may be an epoxy adhesive. In embodiments of the invention, first reed adhesive 132 may be UV15X-6MED-2. In embodiments of the invention, first reed adhesive 132 may be a cyanoacrylate such as Loctite 4861.

In embodiments of the invention, encapsulation shield 128 may be a flexible cyanoacrylate adhesive. In embodiments of the invention, encapsulation shield 128 may be Loctite 4861. In embodiments of the invention, encapsulation shield 128 may be a flexible epoxy or flexible silicone adhesive. In embodiments of the invention, encapsulation shield 128 may have the following characteristics: a relatively low durometer, e.g., 95A on the Shore scale or less; a durometer which is higher than the durometer of the ingress membrane material; a durometer which is within ten percent of the durometer of the ingress membrane material; or a viscosity of between approximately 3000 and 5500 centipoise.

In embodiments of the invention, membrane mounting ring adhesive 122 may be an epoxy adhesive. In embodiments of the invention, membrane mounting ring adhesive 122 may be UV15X-6MED-2. In embodiments of the invention, membrane mounting ring adhesive may be a cyanoacrylate such as Loctite 4861. In embodiments of the invention, membrane mounting ring adhesive 122 may be UV curable.

In embodiments of the invention, the adhesive used for bonding the ingress membrane to the reed is Loctite 4861. Pretreatment of the ingress membrane to reed interface with a corona discharge is not required.

One drawback in using materials such as Estane 58300, ChronoSil, and THV as an ingress membrane is the difficulty bonding these materials to, for example, the stainless steel ring and/or the reed of the microactuator. In embodiments of the invention, the bonding characteristics of the ingress membrane may be improved by using plasma to create active sites on the surface of the ingress membrane. In embodiments of the invention, the ingress membrane is plasma treated before it is attached to the microactuator. Covalent bonding between the ingress membrane and the adhesive is a result of the creation of chemical functional groups through plasma treatments.

In embodiments of the invention, in order to facilitate ingress membrane attachment, the microactuator (which, in some embodiments, is coated in a protective coating of parylene) and the ingress membrane may be subjected to a plasma treatment prior to being combined. In embodiments of the invention, the purpose of the plasma treatment is to wet the mating surfaces. Wetting of the mating surfaces is designed to allow the ingress membrane adhesive, e.g., epoxy, to flow more freely and to create chemical functional groups on the surface of the parylene coating material and the surface of the ingress membrane. These chemical functional groups may act to strengthen the bond between the ingress membrane adhesive and the parylene and between the ingress membrane adhesive and the ingress membrane. In embodiments of the invention, wetting may be accomplished using an oxygen/argon plasma, but other plasmas can also be used. Alternatively, the ingress membrane may be attached to the microactuator without a wetting treatment. In embodiments of the invention, the ingress membrane may be treated using processes to enhance its ability to bond with adhesives. In embodiments of the invention, the ingress membrane may be treated using plasma. In embodiments of the invention, plasma treatment of ingress membranes will result in the incorporation of chemical functional groups such as hydroxyls (—OH) and carboxylic acids (—COOH) that bond well to epoxy adhesives such as (OG116-31). In embodiments of the invention, plasma treatment of Chronosil will result in the incorporation of similar chemical functional groups and therefore should improve the bond strength between ChronoSil and parylene.

In embodiments of the invention, the plasma treatment uses an oxygen-argon plasma. In embodiments of the invention, the treatment time in the plasma may be approximately five minutes. In embodiments of the invention, the plasma treatment may include placing the ingress membrane into a vacuum set point of approximately 274.6 mTorr.

In embodiments of the invention, one or both the ingress membrane and the coating (e.g., Parylene-C) of the microactuator body may be subject to surface treatments.

In embodiments of the invention, the invention is directed to a method of preventing fluid ingress into a microactuator, wherein an ingress membrane, including a mounting ring and an ingress membrane reed opening is affixed to an open end of the microactuator, wherein a microactuator reed extends through the ingress membrane reed opening, the method including the steps of: affixing the ingress membrane to an ingress membrane mounting surface at the open end of the microactuator using an ingress membrane mounting ring adhesive positioned on the ingress mounting surface, wherein the ingress mounting ring adhesive comprises an epoxy adhesive; encapsulating an interface between the ingress membrane and the ingress membrane mounting ring adhesive in an encapsulation shield, the encapsulation shield being a flexible adhesive, the encapsulation shield comprising a cyanoacrylate; affixing the microactuator reed to the ingress membrane at the ingress membrane reed opening using a first reed adhesive, which may be an epoxy adhesive; covering the first reed adhesive with a second reed adhesive, the second reed adhesive covering the interface between the first reed adhesive and the ingress membrane and the second reed adhesive covering the interface between the first reed adhesive and the reed, the second reed adhesive comprising a flexible material, the second reed adhesive comprising a cyanoacrylate.

Embodiments of the invention are directed to a microactuator including: an outer shell, the outer shell including a microactuator reed opening at a distal end thereof, the outer shell being constructed of a ferrous material; a microactuator reed extending an interior of the outer shell though the microactuator reed opening; an ingress membrane mounting surface connected to the outer shell and surrounding the reed opening; an end ring positioned on the microactuator at a distal end of the outer shell, the end ring comprising stainless steel, the end ring including an ingress membrane mount surface at a distal end thereof; an ingress membrane mounting ring adhesive positioned on the ingress membrane mounting surface, wherein the ingress membrane mounting ring adhesive comprises an epoxy adhesive; an ingress membrane, including a mounting ring and a central section, wherein the mounting ring surrounds the central portion, the ingress membrane comprising polyurethane, the ingress membrane comprising polyetherurethane, the mounting ring being positioned on the ingress membrane mounting ring adhesive; an ingress membrane reed opening in the central section of the ingress membrane, wherein the microactuator reed extends through the ingress membrane reed opening; an encapsulation shield, the encapsulation shield being mounted on the support band and extending over the ingress membrane mounting ring, the encapsulation shield comprising a cyanoacrylate, the encapsulation shield being flexible; a first reed adhesive connecting the ingress membrane to the microactuator reed at the ingress membrane reed opening, wherein the first reed adhesive comprises an epoxy adhesive; a second reed adhesive positioned on and covering the first reed adhesive, the second reed adhesive extending from the ingress membrane to the microactuator reed, the second reed adhesive comprising a cyanoacrylate, the encapsulation shield being flexible.

The present invention is directed to an ingress membrane for use in sealing the open end of a balanced armature microactuator used in a hearing aid lens mounted on the eardrum of a user. In embodiments of the invention, the ingress membrane may be formed of ChronoSil (a polycarbonate/silicon blend) and may be attached to the microactuator using an OG116-31 epoxy. The ingress membrane may be attached to the microactuator at a stainless steel support member and at the microactuator reed. In embodiments of the invention, in order to facilitate attachment, the microactuator (which may be coated in a protective coating of, for example, parylene) and the ingress membrane may be subjected to a plasma treatment prior to attaching the ingress membrane to the microactuator. The purpose of the plasma treatment is to wet the surfaces (to allow the epoxy to flow more freely) and to create chemical functional groups on the surface of the parylene and ingress membrane (to strengthen the bond between the epoxy and the parylene/ingress membrane). In embodiments of the invention, the stainless steel ring provides a platform for attaching the ingress membrane. In embodiments of the invention, the ingress membrane acts as a barrier to prevent liquid and/or particle ingress. In embodiments of the invention, the reed may be a very thin material which bends easily. In embodiments of the invention, the ingress membrane may be designed as a bellows to minimize its stiffness and the impact connecting it to the reed has on reed motion.

In embodiments of the invention, the microactuator ingress membrane (made of, for example, a polyurethane (Estane 58300) may be bonded to the microactuator body using UV15X-6Med-2. Bonding of the ingress membrane may be followed by a corona discharge treatment of the parylene-C coated microactuator surface. After which a layer of Loctite 4011 may be applied to the ingress membrane and microactuator body at the ring interface. In embodiments of the invention, Loctite 4011 is applied down the body approximately 0.5 mm with a Foam Tip Swab and Fine Tip Spatula.

In embodiments of the invention, it is desirable to limit the amount of adhesive applied to the ring and/or to the reed as an excess of an adhesive at either the ring or the reed has the potential to result in: Interference with assembly components downstream in the process; preventing execution of the final tympanic lens assembly; added weight to the assembly (in embodiments of the invention it is desirable to keep the moving mass of the contact hearing device to less than approximately 120 mg); undesirable modification of the hearing aid response; and distortion.

In embodiments of the invention, other adhesives, ingress membrane materials, and surface treatments may be considered. For example, the Estane 58300+UV15X-6Med-2 bond may be reworked by applying an additional thin layer of UV15X-6Med-2, omitting the OG116-31, and then applying a layer of Loctite 7701 and Loctite 4011. In another embodiment, the Estane 58300+UV15X-6Med-2 bond may be reworked by directly applying a layer of Loctite 7701 and 4011, which saves manufacturing time. In another embodiment, the Estane 58300+UV15X-6Med-2 bond may be reworked by applying corona discharge followed by OG116-31, with coverage of approximately 0.5 mm onto the microactuator body, as well as coverage over the top of the stainless steel ring, but not extending onto the ingress membrane which is in the interior of the ring. In another embodiment, the Estane 58300+UV15X-6Med-2 bond may be reworked by applying corona discharge followed by Loctite 4011 at the ring, with coverage of approximately 0.5 mm onto the microactuator body, as well as coverage over the top of the stainless steel ring, but not extending onto the ingress membrane which is in the interior of the ring. The microactuator ingress membrane-to-reed interface may be bonded using Loctite 4861. In another embodiment, the Estane 58300+UV15X-6Med-2 bond may be reworked by applying corona discharge followed by Loctite 4861 at the ring, with coverage of approximately 0.5 mm onto the microactuator body, as well as coverage over the top of the stainless steel ring, but not extending onto the ingress membrane which is in the interior of the ring. In a further embodiment, the microactuator ingress membrane-to-reed interface may be bonded using Loctite 4861. In another embodiment, the Estane 58300 ingress membrane may be secured against fluid ingress by applying a thin, heat-shrinkable tubing such as polyethylene terephthalate (PET) or Teflon, or other heat-shrinkable materials. In embodiments of the invention, any of the above approaches may also be applied to the bond at the interface between the microactuator reed, as well as near the ring, since the reed-ingress membrane interface represents a weak point for fluid ingress. In another embodiment, the Estane 58300 ingress membrane may be secured against fluid ingress at the reed by applying a ring of material around the reed, similar to an o-ring, and then bonding the ingress membrane to that ring. In embodiments of the invention, any of the above approaches may also be applied to the bond at the interface between the microactuator reed, as well as near the ring, since the reed-ingress membrane interface represents a weak point for fluid ingress.

In embodiments of the invention, if an excess amount of adhesive is applied at the ingress membrane to reed interface, it is possible to repeat the magnetization ratio adjustment procedure to bring the microactuator back into specification. At the microactuator ring, an excess of adhesive may be verified using a gauge tool to ensure the width of the microactuator and adhesive build-up does not exceed 3.29±0.01 mm and the height of the microactuator and adhesive build-up does not exceed 1.79±0.01 mm.

In embodiments of the invention, while the Loctite 4011 layer needs to cover at least a portion of the ingress membrane on top of the stainless steel ring, it should not cover any of the ingress membrane on the interior of the ring. This is to prevent a change in ingress membrane stiffness which could cause a change in the output response of the microactuator.

Embodiments of the present invention are directed to a method of preventing fluid ingress into a microactuator, wherein an ingress membrane, including a mounting ring and an ingress membrane reed opening, is affixed to an open end of the microactuator and a microactuator reed extends through the ingress membrane reed opening. In embodiments of the invention, the method including the steps of: affixing the ingress membrane to an ingress membrane mounting surface at the open end of the microactuator using an ingress membrane mounting ring adhesive positioned on the ingress membrane mounting surface; encapsulating an interface between the ingress membrane and the ingress membrane mounting ring adhesive in an encapsulation shield; affixing the microactuator reed to the ingress membrane at the ingress membrane reed opening using a first reed adhesive; covering the first reed adhesive with a second reed adhesive, the second reed adhesive: covering an interface between the first reed adhesive and the ingress membrane; and covering an interface between the first reed adhesive and the reed. In embodiments of the invention, the ingress mounting ring adhesive includes an epoxy adhesive. In embodiments of the invention, the encapsulation shield includes a flexible adhesive. In embodiments of the invention, the encapsulation shield includes a cyanoacrylate. In embodiments of the invention, the first reed adhesive includes an epoxy adhesive. In embodiments of the invention, the second reed adhesive includes a flexible material. In embodiments of the invention, the second reed adhesive includes a cyanoacrylate.

Embodiments of the present invention are directed to a method of preventing fluid ingress into a microactuator wherein an ingress membrane, the ingress membrane including a mounting ring and an ingress membrane reed opening, is affixed to an open end of the microactuator, a microactuator reed extending through the ingress membrane reed opening. In embodiments of the invention, the method includes the steps of: affixing the ingress membrane to an ingress membrane mounting surface at the open end of the microactuator using an ingress membrane mounting ring adhesive positioned on the ingress mounting surface, wherein the ingress mounting ring adhesive includes an epoxy adhesive; encapsulating an interface between the ingress membrane and the ingress membrane mounting ring adhesive in an encapsulation shield, the encapsulation shield including a flexible adhesive including a cyanoacrylate; affixing the microactuator reed to the ingress membrane at the ingress membrane reed opening using a first reed adhesive, wherein the first reed adhesive includes an epoxy adhesive; covering the first reed adhesive with a second reed adhesive, the second reed adhesive including a flexible material including a cyanoacrylate, the second reed adhesive: covering an interface between the first reed adhesive and the ingress membrane; and covering an interface between the first reed adhesive and the reed.

Embodiments of the present invention are directed to a process for installing an ingress membrane having a first opening and a second opening on a microactuator wherein the microactuator includes a body having a closed end, an open end, a stainless steel ring attached to the body at the open end and an output reed. In embodiments of the invention, the ring surrounds the open end and the output reed extends from the open end of the microactuator. In embodiments of the invention, the process including the steps of: coating the microactuator body with a corrosion resistant coating, wherein the corrosion resistant coating includes Parylene C; positioning the ingress membrane on the microactuator such that the first opening contacts the ring and the reed extends through the second opening; bonding the ingress membrane to the ring, wherein the bonding material includes UV15X-6Med-2 (from Masterbond), the bonding material being positioned between the ingress membrane and the ring; applying a layer of encapsulating material including Loctite 4011 to the ingress membrane, the layer of encapsulating material being applied over the ingress membrane at the point where the ingress membrane is affixed to the microactuator surface; bonding the ingress membrane to the output reed, wherein the bonding material includes UV15X-6Med-2, the bonding material being positioned between the ingress membrane and the output reed; applying a layer of encapsulating material including Loctite 4011 to the ingress membrane, the layer of encapsulating material being applied over the ingress membrane at the point where the ingress membrane is affixed to the output reed. In embodiments of the invention, the ingress membrane includes a polyurethane such as Estane 58300. In embodiments of the invention the corrosion resistant coating is treated with a corona discharge.

Embodiments of the present invention are directed to a microactuator including: an outer shell, the outer shell including a microactuator reed opening at a distal end thereof; a microactuator reed extending from an interior of the outer shell though the microactuator reed opening; an ingress membrane mounting surface connected to the outer shell and surrounding the microactuator reed opening; an ingress membrane mounting ring adhesive positioned on the ingress membrane mounting surface; an ingress membrane, the ingress membrane including a mounting ring and a central section, wherein the mounting ring surrounds the central section, the mounting ring being positioned on the ingress membrane mounting ring adhesive; an ingress membrane reed opening in the central portion of the ingress membrane, wherein the microactuator reed extends through the ingress membrane reed opening; an encapsulation shield, the encapsulation shield extending over the ingress membrane mounting ring; a first reed adhesive connecting the ingress membrane to the microactuator reed at the ingress membrane reed opening; a second reed adhesive positioned on and covering the first reed adhesive, the second reed adhesive: covering an interface between the first reed adhesive and the ingress membrane; and covering an interface between the first reed adhesive and the reed. In embodiments of the present invention, the outer shell is constructed of a ferrous material. In embodiments of the present invention, an end ring is positioned on the microactuator at a distal end of the outer shell, the end ring: including stainless steel; and including the ingress membrane mounting surface at a distal end thereof. In embodiments of the present invention, the ingress membrane mounting ring adhesive includes an epoxy adhesive. In embodiments of the present invention, the ingress membrane includes a polyurethane. In embodiments of the present invention, the ingress membrane includes a polyetherurethane. In embodiments of the present invention, the microactuator is mounted on the support band. In embodiments of the present invention, the encapsulation shield includes a flexible material. In embodiments of the present invention, the encapsulation shield includes a cyanoacrylate. In embodiments of the present invention, the first reed adhesive includes an epoxy adhesive. In embodiments of the present invention, the second reed adhesive extends from the ingress membrane to the microactuator reed. In embodiments of the present invention, the second reed adhesive includes a flexible material. In embodiments of the present invention, the second reed adhesive includes a cyanoacrylate.

Embodiments of the present invention are directed to a microactuator including: an outer shell, the outer shell including a microactuator reed opening at a distal end thereof, the outer shell being constructed of a ferrous material; a microactuator reed extending from an interior of the outer shell though the microactuator reed opening; an ingress membrane mounting surface connected to the outer shell and surrounding the microactuator reed opening; an end ring positioned on the microactuator at a distal end of the outer shell, the end ring including stainless steel, the end ring including the ingress membrane mounting surface at a distal end thereof; an ingress membrane mounting ring adhesive positioned on the ingress membrane mounting surface, wherein the ingress membrane mounting ring adhesive includes an epoxy adhesive; an ingress membrane, including a mounting ring and a central section, wherein the mounting ring surrounds the central section, the ingress membrane including either polyurethane, or polyetherurethane, the mounting ring being positioned on the ingress membrane mounting ring adhesive; an ingress membrane reed opening in the central portion of the ingress membrane, wherein the microactuator reed extends through the ingress membrane reed opening; an encapsulation shield, the encapsulation shield being mounted on the support band and extending over the ingress membrane mounting ring, the encapsulation shield including a flexible material, the encapsulation shield includes cyanoacrylate; a first reed adhesive connecting the ingress membrane to the microactuator reed at the ingress membrane reed opening, wherein the first reed adhesive includes an epoxy adhesive; a second reed adhesive positioned on and covering the first reed adhesive, the second reed adhesive: covering an interface between the first reed adhesive and the ingress membrane; covering an interface between the first reed adhesive and the reed; extending from the ingress membrane to the microactuator reed; including a flexible material; and including cyanoacrylate.

Embodiments of the present invention are directed to a microactuator, the microactuator including: a body having a first and second ends, wherein the first end is closed and the second end is open; an output reed extending from the second end of the body; a ring surrounding the second end of the body; an ingress membrane having a first opening and a second opening, wherein the first opening is connected to the body at the ring and the output reed extends through the second opening; a first adhesive disposed between the first opening and the ring such that the first opening is affixed to the body at the ring; a second adhesive disposed between the second opening and the output reed such that the second opening is affixed to the output reed; a first shield encapsulating the first adhesive to ring junction to form a first encapsulated junction; a second shield encapsulating the second adhesive to output reed junction. In embodiments of the present invention, the first encapsulated junction is impermeable to fluid ingress. In embodiments of the present invention, the second encapsulated junction is impermeable to fluid ingress. In embodiments of the present invention, the body is coated with a scratch resistant coating. In embodiments of the present invention, the scratch resistant coating is treated with a plasma treatment.

In embodiments of the present invention, a contact hearing device may be a tiny actuator connected to a customized ring-shaped support platform that floats on the ear canal around the eardrum, where the actuator directly vibrates the eardrum causing energy to be transmitted through the middle and inner ears to stimulate the brain and produce the perception of sound. The contact hearing device may comprise a photodetector, a microactuator connected to the photodetector and a support structure supporting the photodetector and microactuator. The contact hearing device may comprise an antenna, a microactuator connected to the antenna and a support structure supporting the antenna and microactuator. The contact hearing device may comprise a coil, a microactuator connected to the coil and a support structure supporting the coil and microactuator. The contact hearing device may also be referred to as a Tympanic Contact Actuator (TCA), a Tympanic Lens, a Tympanic Membrane Transducer (TMT), a smart lens.

While the preferred embodiments of the devices and methods have been described in reference to the environment in which they were developed, they are merely illustrative of the principles of the present inventive concepts. Modification or combinations of the above-described assemblies, other embodiments, configurations, and methods for carrying out the invention, and variations of aspects of the invention that are obvious to those of skill in the art are intended to be within the scope of the claims. In addition, where this application has listed the steps of a method or procedure in a specific order, it may be possible, or even expedient in certain circumstances, to change the order in which some steps are performed, and it is intended that the particular steps of the method or procedure claim set forth herebelow not be construed as being order-specific unless such order specificity is expressly stated in the claim.

REFERENCE NUMBERS

| Number | Element |
|---|---|
| 100 | Contact Hearing Device (Tympanic Lens) |
| 110 | Motor Assembly |
| 120 | Microactuator Reed |
| 122 | Ingress membrane Mounting Ring Adhesive |
| 124 | Ingress membrane Mounting Ring |
| 126 | Ingress membrane Mounting Surface |
| 128 | Encapsulation Shield |
| 130 | Photodetector |
| 132 | First Reed Adhesive (binding adhesive) |
| 134 | Second Reed Adhesive (protective adhesive/Reed Encapsulation Shield) |
| 136 | Encapsulation Lip |
| 138 | Magnets |
| 140 | Microactuator |
| 150 | Sulcus Platform |
| 155 | Perimeter Platform |
| 160 | Umbo Platform |
| 170 | Chassis |
| 180 | Bias Spring |
| 182 | Hypo-Tubes |
| 184 | Microactuator Wires |
| 185 | Damper |
| 186 | Photodetector Wires |
| 188 | End Ring (Stainless Steel) |
| 190 | Grasping Tab |
| 192 | Reed Slot |
| 194 | Potting Material |
| 200 | Drive Post |
| 202 | Outer Edge of Ingress membrane Mounting Ring 124 |
| 204 | Outer Edge of Ingress membrane Mounting Ring Adhesive 122 |
| 206 | Outer Edge of Ingress membrane Mounting Surface 126 |
| 210 | Adhesive |
| 220 | Umbo Lens |
| 230 | Reed Tip |
| 240 | Ingress membrane |
| 350 | Microactuator Reed |

The invention claimed is:

1. A method of preventing fluid ingress into a microactuator, wherein an ingress membrane, comprising a mounting ring and an ingress membrane reed opening, is affixed to an open end of the microactuator, a microactuator reed extending through the ingress membrane reed opening, the method comprising the steps of:

affixing the ingress membrane to an ingress membrane mounting surface at the open end of the microactuator using an ingress membrane mounting ring adhesive positioned on the ingress membrane mounting surface;

encapsulating an interface between the ingress membrane and the ingress membrane mounting ring adhesive in an encapsulation shield;

affixing the microactuator reed to the ingress membrane at the ingress membrane reed opening using a first reed adhesive;

covering the first reed adhesive with a second reed adhesive, the second reed adhesive:

covering an interface between the first reed adhesive and the ingress membrane; and covering an interface between the first reed adhesive and the reed.

2. The method of claim 1 wherein the ingress mounting ring adhesive comprises an epoxy adhesive.

3. The method of claim 2 wherein the, the encapsulation shield comprises a flexible adhesive.

4. The method of claim 3 wherein the encapsulation shield comprises a cyanoacrylate.

5. The method of claim 1 wherein the first reed adhesive comprises an epoxy adhesive.

6. The method of claim 1 wherein the second reed adhesive comprises a flexible material.

7. The method of claim 6 wherein the second reed adhesive comprises a cyanoacrylate.

8. A method of preventing fluid ingress into a microactuator, wherein an ingress membrane, the ingress membrane comprising a mounting ring and an ingress membrane reed opening, is affixed to an open end of the microactuator, a microactuator reed extending through the ingress membrane reed opening, the method comprising the steps of:

affixing the ingress membrane to an ingress membrane mounting surface at the open end of the microactuator using an ingress membrane mounting ring adhesive positioned on the ingress mounting surface, wherein the ingress mounting ring adhesive comprises an epoxy adhesive;

encapsulating an interface between the ingress membrane and the ingress membrane mounting ring adhesive in an encapsulation shield, the encapsulation shield comprising a flexible adhesive comprising a cyanoacrylate;

affixing the microactuator reed to the ingress membrane at the ingress membrane reed opening using a first reed adhesive, wherein the first reed adhesive comprises an epoxy adhesive;

covering the first reed adhesive with a second reed adhesive, the second reed adhesive comprising a flexible material comprising a cyanoacrylate, the second reed adhesive:

covering an interface between the first reed adhesive and the ingress membrane; and covering an interface between the first reed adhesive and the reed.

9. A microactuator comprising:

an outer shell, the outer shell including a microactuator reed opening at a distal end thereof;

a microactuator reed extending from an interior of the outer shell though the microactuator reed opening;

an ingress membrane mounting surface connected to the outer shell and surrounding the microactuator reed opening;

an ingress membrane mounting ring adhesive positioned on the ingress membrane mounting surface;

an ingress membrane, the ingress membrane comprising a mounting ring and a central section, wherein the mounting ring surrounds the central section, the mounting ring being positioned on the ingress membrane mounting ring adhesive;

an ingress membrane reed opening in the central portion of the ingress membrane, wherein the microactuator reed extends through the ingress membrane reed opening;

an encapsulation shield, the encapsulation shield extending over the ingress membrane mounting ring;

a first reed adhesive connecting the ingress membrane to the microactuator reed at the ingress membrane reed opening;

a second reed adhesive positioned on and covering the first reed adhesive, the second reed adhesive:

covering an interface between the first reed adhesive and the ingress membrane; and covering an interface between the first reed adhesive and the reed.

10. A microactuator according to claim 9 wherein the outer shell is constructed of a ferrous material.

11. A microactuator according to claim 9 wherein an end ring is positioned on the microactuator at a distal end of the outer shell, the end ring:

comprising stainless steel; and including the ingress membrane mounting surface at a distal end thereof.

12. A microactuator according to claim 9 wherein the ingress membrane mounting ring adhesive comprises an epoxy adhesive.

13. A microactuator according to claim 9 wherein the ingress membrane comprises polyurethane.

14. A microactuator according to claim 9 wherein the ingress membrane comprises polyetherurethane.

15. A microactuator according to claim 9 wherein the ingress membrane comprises a terpolymer of tetrafluoroethylene, hexafluoropropylene and vinylidene fluoride.

16. A microactuator according to claim 9 wherein the microactuator is mounted on the support band.

17. A microactuator according to claim 9 wherein the encapsulation shield comprises a flexible material.

18. A microactuator according to claim 9 wherein the encapsulation shield comprises a cyanoacrylate.

19. A microactuator according to claim 9 wherein the first reed adhesive comprises an epoxy adhesive.

20. A microactuator according to claim 9 wherein the second reed adhesive extends from the ingress membrane to the microactuator reed.

21. A microactuator according to claim 9 wherein the second reed adhesive comprises a flexible material.

22. A microactuator according to claim 9, the second reed adhesive comprising a cyanoacrylate.

23. A microactuator comprising:

an outer shell, the outer shell including a microactuator reed opening at a distal end thereof, the outer shell being constructed of a ferrous material;

a microactuator reed extending from an interior of the outer shell though the microactuator reed opening;

an ingress membrane mounting surface connected to the outer shell and surrounding the microactuator reed opening;

an end ring positioned on the microactuator at a distal end of the outer shell, the end ring comprising stainless steel, the end ring including the ingress membrane mounting surface at a distal end thereof;

an ingress membrane mounting ring adhesive positioned on the ingress membrane mounting surface, wherein the ingress membrane mounting ring adhesive comprises an epoxy adhesive;

an ingress membrane, including a mounting ring and a central section, wherein the mounting ring surrounds the central section, the ingress membrane comprising either polyurethane, or polyetherurethane, the mounting ring being positioned on the ingress membrane mounting ring adhesive;

an ingress membrane reed opening in the central portion of the ingress membrane, wherein the microactuator reed extends through the ingress membrane reed opening;

an encapsulation shield, the encapsulation shield being mounted on the support band and extending over the ingress membrane mounting ring, the encapsulation shield comprising a flexible material, the encapsulation shield comprising cyanoacrylate;

a first reed adhesive connecting the ingress membrane to the microactuator reed at the ingress membrane reed opening, wherein the first reed adhesive comprises an epoxy adhesive;

a second reed adhesive positioned on and covering the first reed adhesive, the second reed adhesive:

covering an interface between the first reed adhesive and the ingress membrane;

covering an interface between the first reed adhesive and the reed;

extending from the ingress membrane to the microactuator reed;

comprising a flexible material; and comprising cyanoacrylate.

* * * * *